US006490876B2

(12) United States Patent
Derryberry et al.

(10) Patent No.: US 6,490,876 B2
(45) Date of Patent: Dec. 10, 2002

(54) METHOD AND APPARATUS FOR DE-ICING DEHUMIDIFIER

(75) Inventors: Andy Lynn Derryberry, Nashville, TN (US); David Michael Jackson, Murfreesboro, TN (US); Jon Donald Tromblee, Coloma, MI (US); Jurgen Pannock, Brentwood, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/782,447

(22) Filed: Feb. 13, 2001

(65) Prior Publication Data

US 2001/0045098 A1 Nov. 29, 2001

Related U.S. Application Data

(60) Provisional application No. 60/182,435, filed on Feb. 15, 2000.

(51) Int. Cl.[7] ..... F25D 21/06
(52) U.S. Cl. ..... 62/156; 62/155; 62/227
(58) Field of Search ..... 62/151, 156, 157, 62/234, 227, 155

(56) References Cited

U.S. PATENT DOCUMENTS

| | | | | | |
|---|---|---|---|---|---|
| 2,847,833 | A | | 8/1958 | Merrick | 62/155 |
| 2,934,323 | A | | 4/1960 | Burke | 257/274 |
| 3,107,499 | A | | 10/1963 | Jokela | 62/140 |
| 3,277,662 | A | | 10/1966 | Winters | 62/155 |
| 3,436,929 | A | | 4/1969 | Harbour | 62/155 |
| 3,518,841 | A | | 7/1970 | West, Jr. | 62/153 |
| 3,636,724 | A | * | 1/1972 | Moy | 62/227 X |
| 3,785,166 | A | * | 1/1974 | Schrader | 62/227 |
| 3,918,268 | A | | 11/1975 | Nussbaum | 62/150 |
| 4,056,948 | A | | 11/1977 | Goodhouse | 62/155 |
| 4,265,092 | A | | 5/1981 | Abraham | 62/155 |
| 4,291,542 | A | | 9/1981 | Sminge et al. | 62/156 |
| 4,627,245 | A | * | 12/1986 | Levine | 62/234 X |
| 4,646,529 | A | | 3/1987 | Hanson | 62/155 |
| 4,745,766 | A | | 5/1988 | Bahr | 62/176 |

* cited by examiner

*Primary Examiner*—Harry B. Tanner
(74) *Attorney, Agent, or Firm*—Robert O. Rice; Thomas J. Roth; Stephen Krefman

(57) ABSTRACT

A method and apparatus for operating a dehumidifier in a de-ice mode is provided wherein the dehumidifier has an evaporator coil, a fan operated by a fan motor to cause a flow of ambient air over the evaporator coil, and a compressor operated by a compressor motor to cause a flow of refrigerant to the evaporator coil. A control is provided for detecting a characteristic of the dehumidifier associated with the formation of frost on the evaporator coil. Such characteristic could be the temperature of the evaporator coil, the rate of change of the temperature of the coil, a drop in the amp draw of the compressor motor below a predetermined value or a predetermined rate of downward change in the amp draw of the compressor motor. The control terminates power to the compressor motor after detection of the characteristic, either immediately or after a predetermined time, while continuing operation of the fan to provide the melting. Normal operation is resumed when the characteristic is no longer detected, or after passage of a predetermined amount of time.

19 Claims, 6 Drawing Sheets

METHOD AND APPARATUS FOR DE-ICING DEHUMIDIFIER

BACKGROUND OF THE INVENTION

The present invention relates to dehumidifiers and more particularly to a control for de-icing a dehumidifier.

Today's residential dehumidifier is not designed to operate at temperatures lower than about 60° F. to 65° F. Some models have a so-called "de-icer". These devices, however, are simply used to shut off the compressor when room temperature falls below the above mentioned temperatures. U.S. Pat. No. 4,745,766 discloses a dehumidifier control system that utilizes a continuously running timer in parallel with an ambient air thermostat to control the compressor. When the ambient air is below a preset temperature, the timer will cycle the compressor on and off while the fan remains running.

U.S. Pat. No. 4,291,542 discloses a dehumidifier which utilizes a: temperature sensor on the evaporator coil which regulates the fan speed and to initiate a defrost cycle. An ambient air temperature sensor is used to bias the preset temperature of the evaporator temperature sensor. The defrost cycle is accomplished by reversing the flow of refrigerant through the system with continuous operation of the compressor and terminating operation of the fan.

U.S. Pat. No. 4,646,529 discloses a refrigeration system which utilizes a sensor to measure evaporator temperature and a sensor to measure ambient air temperature. When either temperature is below a predetermined value for that sensor, a timer accumulates time, and when both the timer has accumulated sufficient time and the evaporator temperature is low, heat will be applied to the evaporator coil to defrost it by means of reversing the flow of refrigerant through the system with the continuous operation of the compressor.

At ambient temperatures below 65° F., the evaporating temperature of the refrigerant system falls below 32° F. and frost forms on the evaporator coil. In a short period of time the coil is totally blocked and the unit must be defrosted. The evaporator temperature will be relatively stable even when there is light to moderate amounts of frost on the coil. When the gaps between the fins fill with frost, however, the evaporating temperature drops steeply. If the unit continues to run, then the evaporating temperature stabilizes again. Once the evaporator is fully frosted, the frost that is formed is not solid or clear ice. However, if the dehumidifier is operated for an extended period of time, usually over thirty minutes to an hour, then the frost turns into a solid, clear type ice.

It would be an advantage if a relatively simple control were provided which measures a characteristic of the dehumidifier which indicates formation of frost on the evaporator coil, and then terminating operation of the compressor to allow the frost to melt by the continuous operation of the fan drawing ambient air over the coil.

SUMMARY OF THE INVENTION

The present invention recognizes that certain characteristics, such as the coil temperature, during the formation of frost on the evaporator coil are predictable and can be used as a basis for defrosting. That is, the evaporator temperature remains stable when there is light to moderate amounts of frost on the coil, but when the gaps between the fins fill with frost, the evaporating temperature drops steeply between the range of 30° F. to 10° F.

Applicants have determined that a detection of the characteristic of the steep temperature drop, or temperature in this range, can be used to initiate various defrosting strategies.

Also what Applicants recognize is that the initial frost that is formed is not solid or clear ice so that it can be defrosted quickly and efficiently. However, once the frost turns into the solid, clear type ice, this ice is more difficult to melt due to its higher density and takes more time. In such event, the dehumidification effectiveness is reduced.

In one aspect of the invention, a bi-metal temperature switch is selected to operate within the range of the steep temperature drop described above. The switch is used to turn the compressor off (while leaving the unit fan on) and, thus, allow ambient air flow across the evaporator to remove the frost. The bi-metal device is set to shut the compressor off before the evaporator temperature is lower than the area of steep temperature drop, thus preventing the onset for clear ice formation. The bi-metal switch is set to turn the compressor on when the coil temperature has risen above the area of steep temperature drop, as well as above the freezing point, in order to ensure a full melting of the created soft ice or frost.

In another aspect of the invention, a bi-metal temperature switch and a duty cycle timer are combined. The bi-metal switch changes position when the evaporator has entered the steep temperature drop area (indicating frosting conditions) and then enables a timer which cycles the compressor. The timer accumulates the time during which the ice forms, i.e., in which the evaporator temperature is in or below the steep temperature drop area or below 32° F. Once the accumulated time reaches a certain value that still guarantees soft ice (typically, but not limited to, 30–60 minutes), the timer switches the compressor off and the ice is defrosted with ambient air by continuous operation of the fan.

In another aspect of the invention an electronic control measures the evaporator temperature with a solid state sensor. Logic in the control then cycles the compressor based upon either the sensed temperature of the evaporator coil, or based upon the rate of downward change of the sensed temperature as described above with respect to the earlier described aspect of the invention.

The invention is not limited to any particular mechanical or electronic arrangement of parts. Electronic measurement, timing and switching can be accomplished in a variety of manners. Further, the control parameters should not be limited to temperature or rate of change of temperature. For example, when measuring the amp draw of the dehumidifier unit, a very distinct and similar behavior can be observed when monitored over time. That is, the amp draw will measurably and quickly decrease when ice is formed over the whole coil. Thus, an amp sensor can be used in lieu of the bi-metal switch or the temperature sensor.

DETAILED DESCRIPTION OF THE PREFERRED EMBODIMENTS

Figure 1:
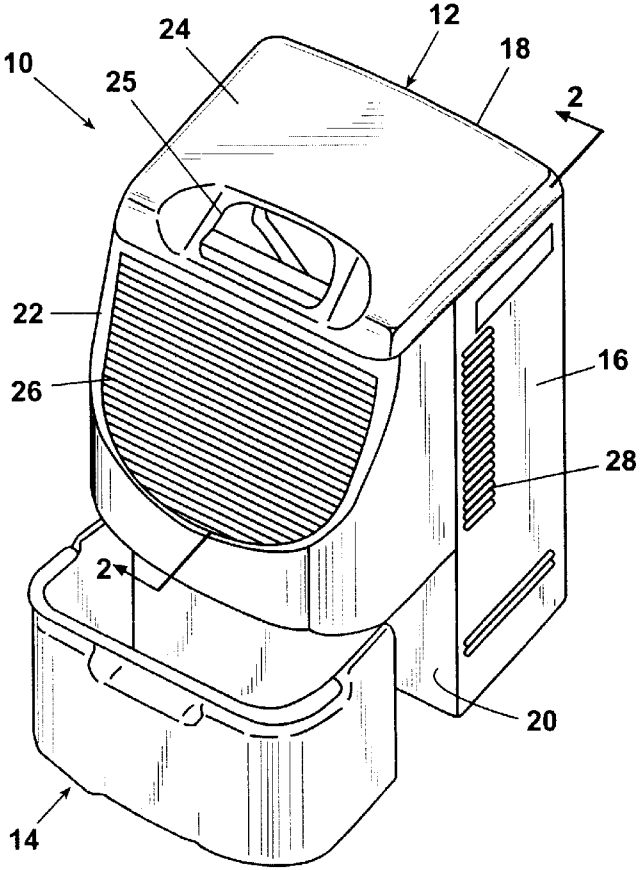
FIG. 1 illustrates a dehumidifier in which the present invention can be utilized.

FIG. 1 illustrates a dehumidifier 10 in which the present invention may be utilized. The invention can be utilized in a dehumidifier of any construction and arrangement and is not limited to the arrangement illustrated in the figures. Nevertheless, a suitable dehumidifier 10 is illustrated which comprises a cabinet 12 to which is removably mounted a bucket 14. The cabinet 12 can be conceptually divided into a front and a rear portion. The rear portion comprises opposing sidewall 16, rear wall 18 and a partial front wall 20. The front portion comprises an overhang 22, which is disposed above the bucket 14 when the bucket 14 is mounted to the cabinet 12. A top wall 24 extends across the rear portion and the front portion.

The junction of the lower portion of the overhang 22 and the partial front wall 20 define a recess in which the bucket 14 is received. A control panel 25 is provided on the top wall and includes control elements (described below) for controlling the operations of the dehumidifier 10.

Figure 2:
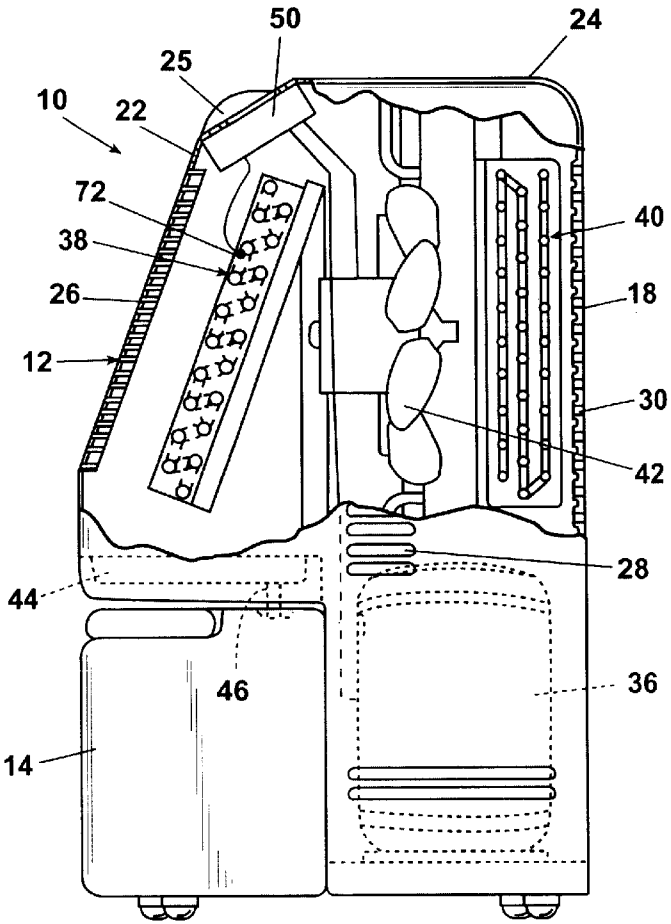
FIG. 2 is a side sectional view taken along the line II—II of FIG. 1.

To provide for air flow through the cabinet, the overhang 22 has a front vent 26, the sidewall 16 have bypass vents 28 and the rear wall 18 has a rear vent 30 (as shown in FIG. 2).

Referring to FIG. 2, the internal structure of the dehumidifier 10 will be described in greater detail. A refrigeration system is disposed within the cabinet 12 of the dehumidifier 10. The refrigeration system comprises a compressor 36, evaporator 38, condenser 40, and a fan 42. This type of refrigeration system is well known in the art and will not be described further. A drip pan 44 is disposed beneath the evaporator 38 to catch the moisture condensed on the evaporator as it drips. The drip pan 44 has a collection tube 46, which directs the dripping liquid into the bucket 14. Typically an interlock switch and float switch are provided to control supply of power to the compressor 36. When the interlock switch is closed, by proper insertion of the bucket 14, the power is engaged to the compressor 36 to run the refrigeration system. A float is provided for detecting the water level within the bucket 14 and if the water level rises above some predetermined height, the switch opens and the power to the compressor 36 is terminated.

Although the present invention is illustrated in FIGS. 1 and 2 in a dehumidifier of a particular design, the particular design is not of consequence. That is, virtually all dehumidifiers, however they are configured, include an evaporator 38 which typically is formed of finned coils to maximize heat transfer from refrigerant flowing through the coils to the large surface area of the fins. The moisture in the air condenses on the fins of the evaporator when it is operated below the dew point temperature of the ambient air and drips into the drip pan 44 from where it is collected into the bucket 14.

When a residential type dehumidifier is operated at ambient temperatures below 65° F., the evaporating temperature of the refrigerant in the evaporator 36 falls below 32° F. causing the water which condenses onto the finned coils of the evaporator to freeze and form frost. Typically the fins on the coils are closely spaced to one another so that in a short period of time, the air passages through the coil are totally blocked by the frost and the evaporator coil must be defrosted. The defrosting can occur by terminating operation of the compressor 36 and continued operation of the fan 42.

Figure 4:
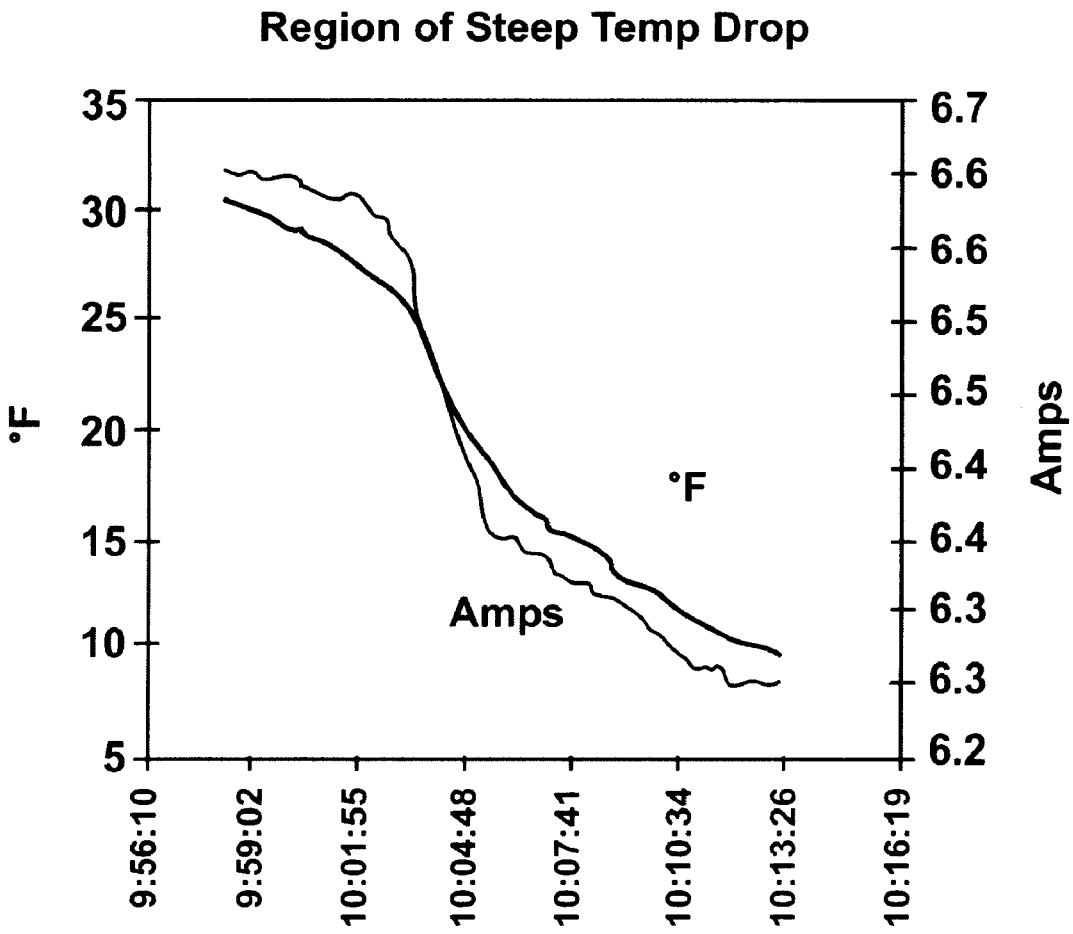
FIG. 4 is a graphic illustration of temperature of the evaporator coil, and amps drawn by the compressor, versus time, during the time period of frost formation.

FIG. 4 illustrates, graphically, the temperature of the evaporator coil 38 during a time while ice begins to form on the coil and it is seen that there is a relatively steep drop from about 30° F. to 10° F. over a period of less than fifteen minutes. FIG. 4 also shows the amp draw of the compressor 36 during the same time period where it is also seen that there is a relatively steep drop in the amp draw from 6.6 amps to 6.3 amps over the same time period.

To accomplish the defrosting of the evaporator coil, as shown in FIG. 2, control components 50 located behind control panel 25 are connected by appropriate electrical lines to the fan 42 which is driven by an electric motor, the compressor 36 which is also operated by an electric motor and to a temperature sensor 72 in some embodiments of the invention, as described below, or to an amp sensor 73 at the compressor in other embodiments.

Figure 3A:
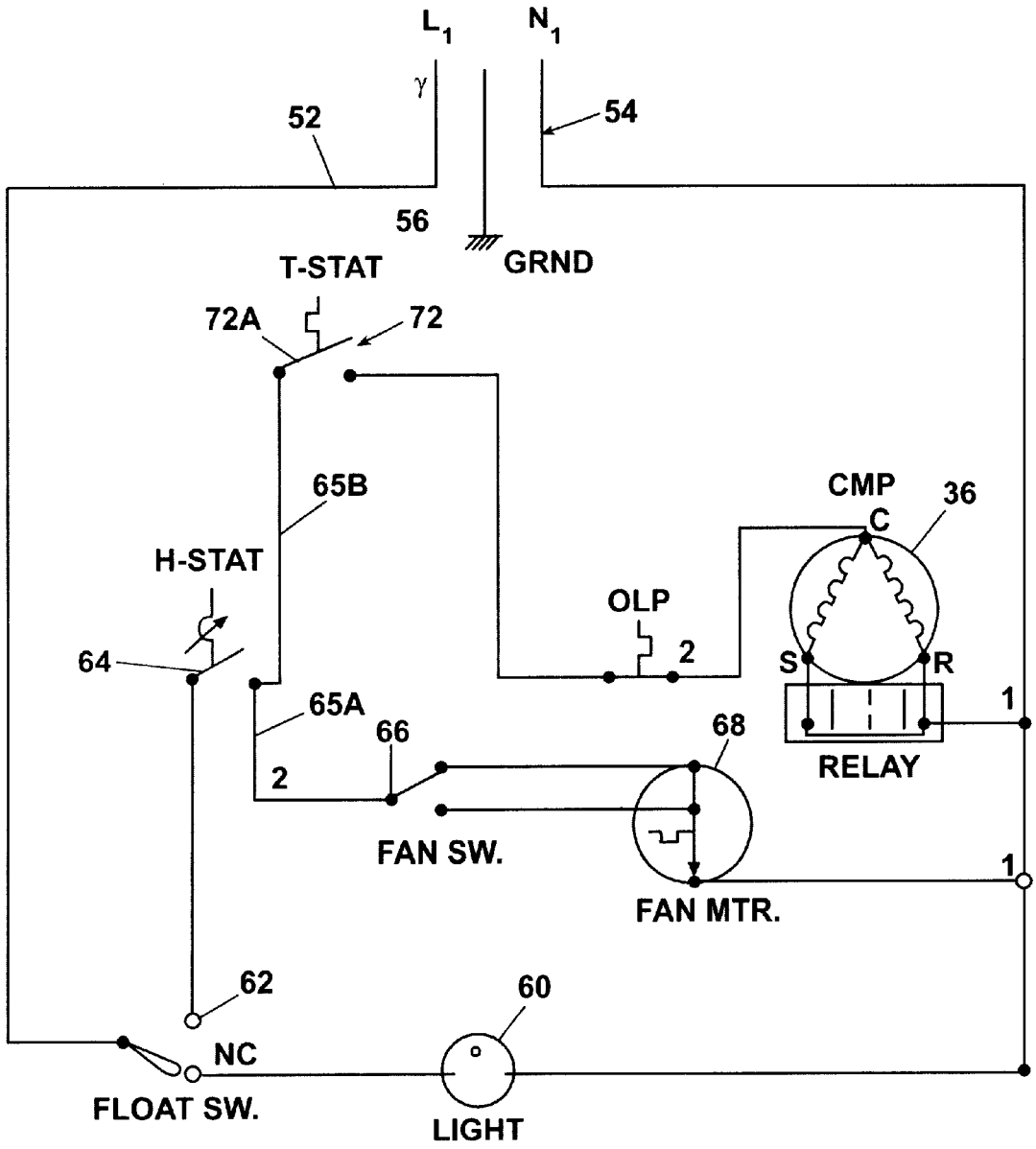
FIG. 3A is a schematic illustration of a control circuit embodying principles of the present invention in a first embodiment.

FIG. 3A illustrates a schematic diagram of a control embodying principles of the present invention in a first embodiment. In other embodiments, many of the components are identical and are numbered the same. On this diagram power is provided to the control on line 52 from a domestic power source, such as 120 volts, 60 hertz AC. A neutral line 54 is provided for completing the circuit and a ground wire 56 is provided as well. A float switch 58 is provided to control operation of the dehumidifier as described above. When the float switch 58 is in a first position as illustrated, power passes through the switch and through a light or other signal device 60 to indicate that the bucket 14 is filled with water and must be emptied. In such condition, the compressor and fan are prevented from operating.

When the water level in the bucket is low enough, the float moves to a second position as indicated at contact 62 in which power is directed to a humidistat switch 64 which detects a humidity level in the ambient air. When the sensed ambient humidity level is above an amount selected by the user at the control panel 25, the humidistat switch 64 will close providing power to other portions of the circuit. Leading on a lower branch 65*a* of the circuit from switch 64, power flows to a fan switch 66 which, in turn, is connected to a fan motor 68 to control operation of the fan motor, and hence the fan 42. As illustrated, the fan switch provide for two speeds for operation of the fan motor, although switches can be used to provide for a wide range of fan speeds, or the fan switch 66 could be left out and the fan motor could be hard wired to provide a single speed of operation.

Leading from humidistat switch 64 along an upper leg 65*b* of the circuit is a thermostat switch 72 which, when closed, applies power to the compressor 36.

In one aspect of the invention, the temperature sensor (FIG. 3A) can comprise a bi-metal temperature switch 72A which is selected to operate within the range of the steep temperature drop shown in FIG. 4. The switch is normally closed, but can be arranged to open, and thereby turn the compressor 36 off, when the temperature drops through the range illustrated. As seen in the circuit of FIG. 3A, this will not affect the power flowing to the fan motor 68 and, hence, ambient air will be drawn across the evaporator coil (which no longer has refrigerant flowing there through) allowing the ambient air to melt the relatively soft ice and frost formed on the evaporator coil. Once the frost has been melted, the temperature of the evaporator coil 38 will rise above the area of the steep temperature drop, causing the bi-metal switch 72A to move back to a closed position thus, again, providing power to the compressor. This switch 72A must be a high power since it must carry the current required to operate the compressor 36.

Figure 3B:
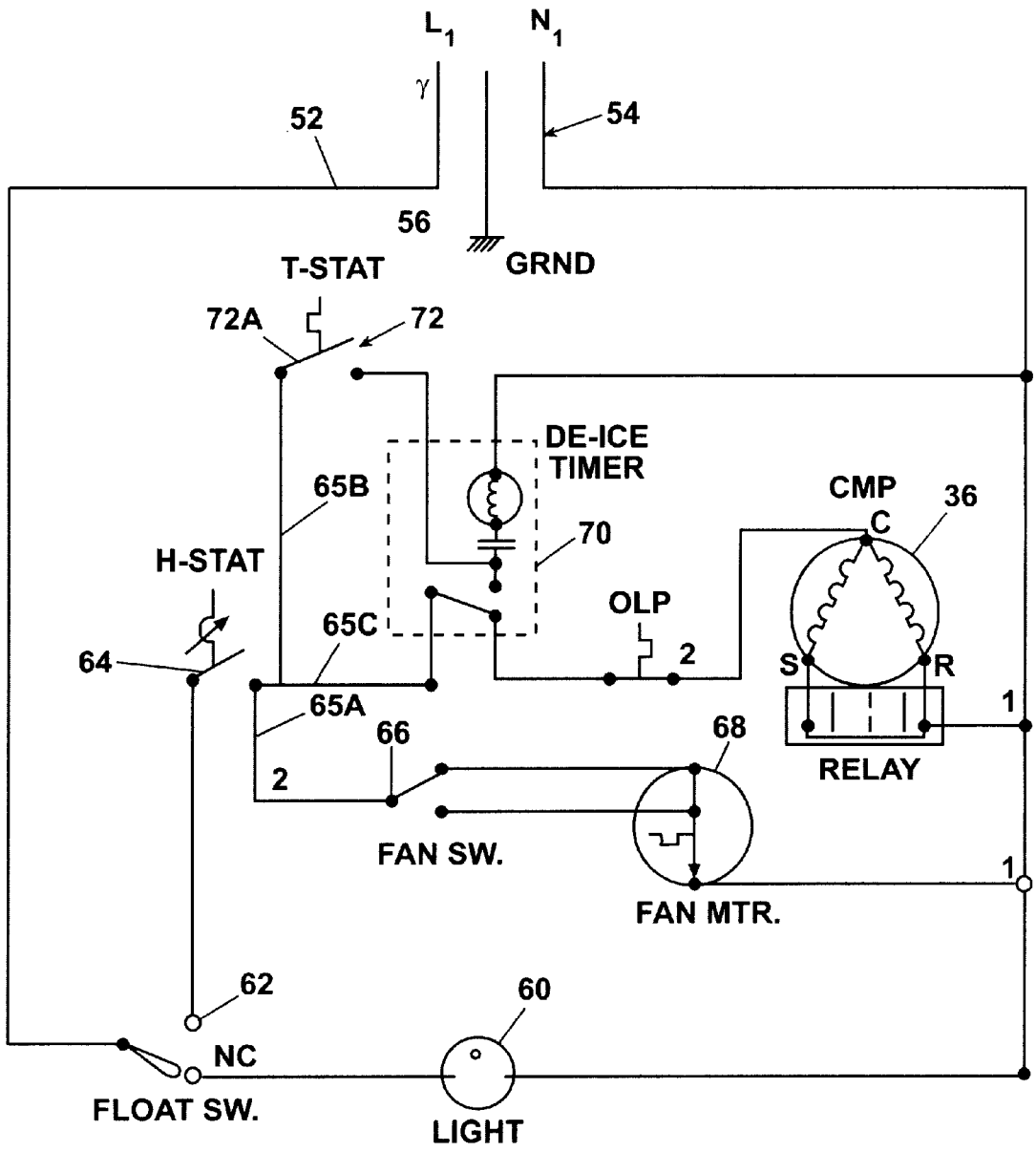
FIG. 3B is a schematic illustration of a control circuit embodying principles of the present invention in a second embodiment.

In a second embodiment of the invention as illustrated in FIG. 3B, different bi-metal temperature switch 72B is used as the temperature sensor and further, a duty cycle timer 70 is provided. In this embodiment, the switch 72B is normally open, but closes when the temperature drops through the range of frost formation. A horizontal leg 65*c* is added to the circuit and the compressor will continue to operate through the horizontal leg connection which passes through the timer 70. When the timer is enabled by closure of the switch 72B, it will accumulate time while the ice is forming, that is, the time during which the evaporator temperature is in or below the steep temperature drop area. Once the accumulated time reaches a certain value that still guarantees soft ice, typically, but not limited to, 30 to 60 minutes, the timer 70 will switch the compressor off by disconnecting the horizontal leg 65*c* of the circuit which passes through the timer and the ice will be defrosted with ambient air by the continuously operating fan motor 68 as described above. In this embodiment, the switch 72B can be a relatively low power switch in that it need only carry a low current as required by the de-ice timer 70, rather than a high current as required by the compressor 36.

Figure 3C:
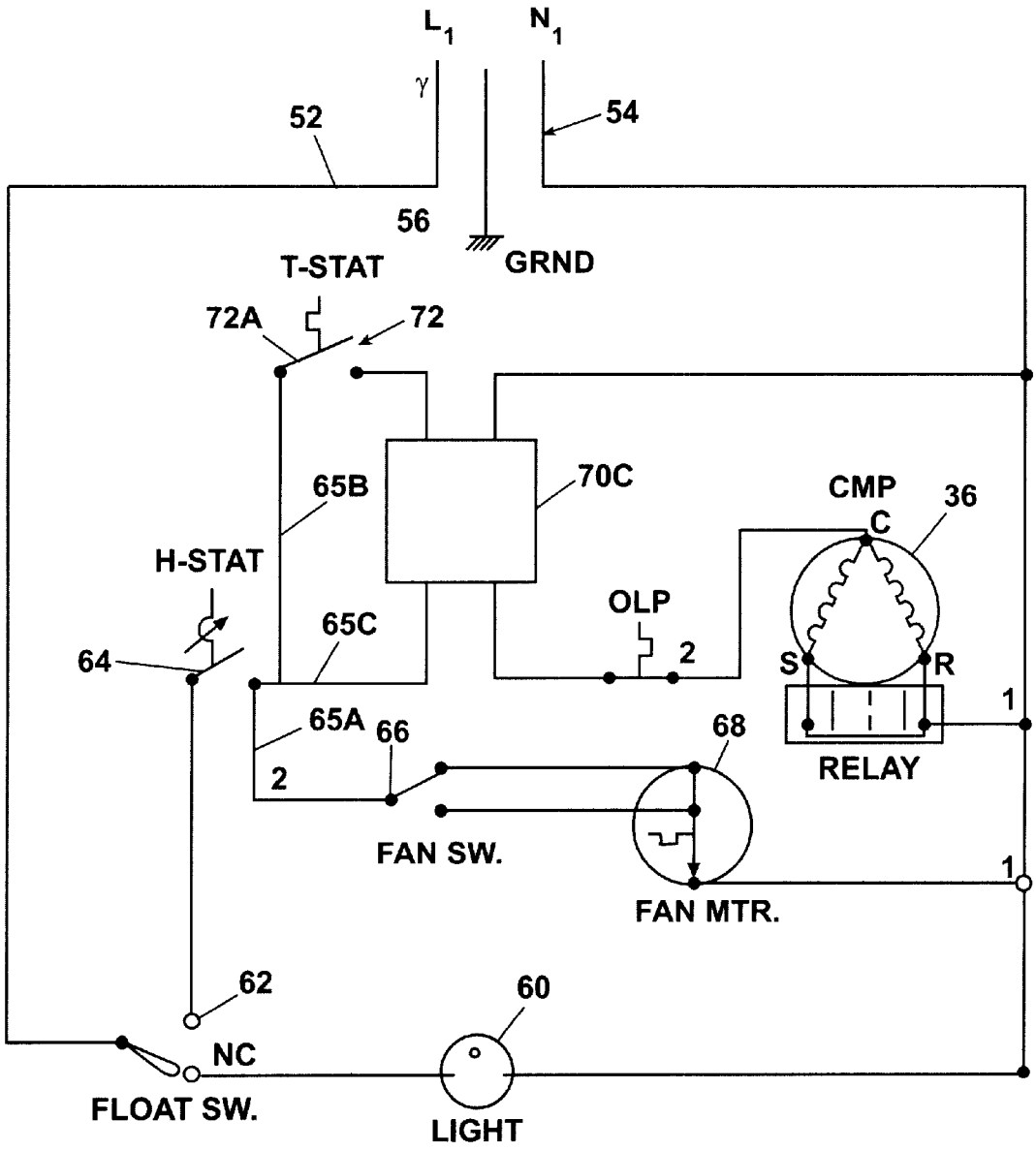
FIG. 3C is a schematic illustration of a control circuit embodying principles of the present invention in a third embodiment.

In another embodiment of the invention illustrated in FIG. 3C, an electronic control 70C can be utilized with a solid state sensor 72C which senses the temperature at the evaporator coil. Logic in the solid state electronic control 70C can cycle the compressor 36 to turn off immediately as described with respect to the first embodiment above either when the sensor 72C detects the steep temperature drop (downward rate of change) or a predetermined (fixed or user variable) temperature or, can permit the compressor to operate for a predetermined time period following the temperature drop through the use of an internal timer before operation of the compressor is terminated. In any event, the fan motor 68 continues to operate to pull ambient air across the evaporator coil to melt the frost. Normal operation can resume after the sensor detects a predetermined temperature (fixed or variable) which indicates that the frost has melted.

Figure 3D:
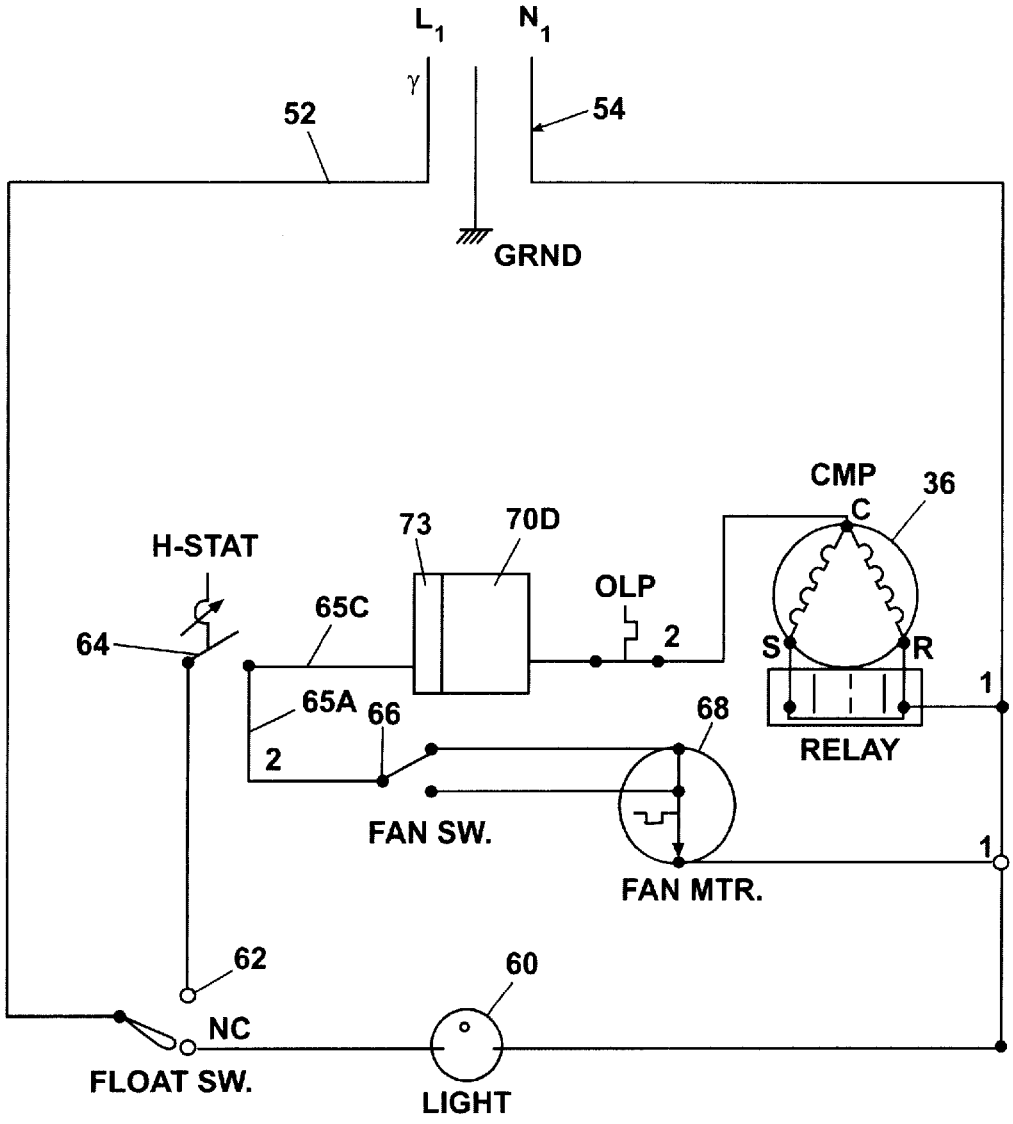
FIG. 3D is a schematic illustration of a control circuit embodying principles of the present invention in a fourth embodiment.

In another embodiment of the invention illustrated in FIG. 3D, the amp sensor 73 is located in the horizontal leg 65*c* leading directly to the compressor 36 from the humidistat 64. An electronic control 70D can be utilized to cycle the compressor 36 to turn off immediately as described with respect to the first embodiment above either when the amp sensor 73 detects a steep amp draw drop (downward rate of change) or an amp drop below a predetermined value for the compressor used which would indicate formation of frost: on the evaporator coil, or can permit the compressor to continue operating for a predetermined time following one of these events. Again, the fan will continue to operate. Of course, since the amperage will drop to zero when compressor operation is terminated, a timer or thermostat on the evaporator coil must be used to determine when power to the compressor should be resumed. That is, power should be resumed after passage of a predetermined (fixed or user variable) length of time or after the evaporator coil temperature is above some predetermined (fixed or user variable) valve.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of operating a dehumidifier having a fan operated by a fan motor, an evaporator coil, and a compressor operated by a compressor motor to cause a flow of refrigerant to said evaporator coil, comprising:

providing power to said fan motor to cause a flow of ambient air over said evaporator coil;

providing power to said compressor motor to supply said refrigerant to said evaporator coil to cool said coil;

detecting a predetermined characteristic of said dehumidifier that undergoes a relatively steep change associated with the formation of frost on said evaporator coil;

terminating power to said compressor motor after detecting said predetermined characteristic while maintaining power to said fan motor to de-ice said evaporator coil by said flow of ambient air; and resuming the provision of power to said compressor motor after no longer detecting said predetermined characteristic.

2. A method according to claim 1, wherein said predetermined characteristic comprises a temperature of said evaporator coil below a predetermined value in the range of relatively steep temperature change.

3. A method according to claim 1, wherein said predetermined characteristic comprises a drop in an amp draw of said compressor motor below a predetermined value.

4. A method according to claim 1, wherein said predetermined characteristic comprises a predetermined relatively steep rate of downward change in a temperature of said evaporator coil.

5. A method according to claim 1, wherein said step of terminating power occurs a predetermined time period after said detecting said predetermined characteristic.

6. A method of operating a dehumidifier having a fan operated by a fan motor, an evaporator coil, and a compressor operated by a compressor motor to cause a flow of refrigerant to said evaporator coil, comprising:

providing power to said fan motor to cause a flow of ambient air over said evaporator coil;

providing power to said compressor motor to supply said refrigerant to said evaporator coil to cool said coil;

detecting a temperature of said evaporator coil characteristic of a steep temperature drop of said evaporator associated with formation of frost on said evaporator;

terminating power to said compressor motor after detecting a first predetermined temperature at said evaporator coil while maintaining power to said fan motor to de-ice said evaporator coil by said flow of ambient air;

resuming the provision of power to said compressor motor after detecting a second predetermined temperature at said evaporator coil.

7. A method according to claim 6, wherein said first predetermined temperature is below 32F.

8. A method according to claim 6, wherein said second predetermined temperature is above 32F.

9. A method according to claim 6, wherein said detecting step is performed by a bi-metal switch.

10. A method according to claim 6, wherein said detecting step is performed by an electronic temperature sensor.

11. A method according to claim 6, wherein said step of terminating power occurs a predetermined time period after said detecting said first predetermined temperature.

12. A method according to claim 6, wherein said step of terminating power occurs immediately upon said detecting said first predetermined temperature.

13. A dehumidifier comprising:

an evaporator coil;

a fan operated by a fan motor to cause a flow of ambient air over said evaporator coil;

a compressor operated by a compressor motor and being connected to said evaporator coil for providing a flow of refrigerant to said evaporator coil to cool said coil;

a control for detecting a predetermined characteristic of said dehumidifier that undergoes a relatively steep change associated with the formation of frost on said evaporator coil;

said control arranged to terminate power to said compressor motor after said control detects said predetermined characteristic while maintaining power to said fan motor to de-ice said evaporator coil by said flow of ambient air; and said control arranged to resume power to said compressor motor after no longer detecting said predetermined characteristic.

14. A dehumidifier according to claim 13, wherein said predetermined characteristic comprises a drop in a temperature of said evaporator coil below a predetermined value in the range of relatively steep change.

15. A dehumidifier according to claim 14, wherein said control comprises a bi-metal switch arranged in power circuit for said compressor motor, said bi-metal switch arranged to change position upon detecting said predetermined temperature value.

16. A dehumidifier according to claim 14, wherein said control further comprises a timer arranged in said power circuit to operate upon said change in position of said bi-metal switch.

17. A dehumidifier according to claim 14, wherein said control comprises an electronic temperature sensor arranged at said evaporator coil.

18. A dehumidifier according to claim 13, wherein said predetermined characteristic comprises a predetermined downward rate of change in an amp draw of said compressor motor.

19. A dehumidifier according to claim 18, wherein said control comprises an amp detector arranged in a power circuit of said compressor motor and a timer for resuming power to said compressor after a predetermined period following detection of said drop in amp draw by said amp detector.

* * * * *